US012077840B2

(12) United States Patent
Camean Queijo et al.

(10) Patent No.: US 12,077,840 B2
(45) Date of Patent: Sep. 3, 2024

(54) 6XXX ALUMINUM ALLOY FOR EXTRUSION WITH EXCELLENT CRASH PERFORMANCE AND HIGH YIELD STRENGTH AND METHOD OF PRODUCTION THEREOF

(71) Applicant: CONSTELLIUM SINGEN GmbH, Singen (DE)

(72) Inventors: Paula Camean Queijo, London (GB); Mehdi Ben Tahar, Grenoble (FR); Alexis Skubich, Lyons (FR); Martin Jarrett, Oxfordshire (GB)

(73) Assignee: CONSTELLIUM SINGEN GMBH, Singen (DE)

( * ) Notice: Subject to any disclaimer, the term of this patent is extended or adjusted under 35 U.S.C. 154(b) by 806 days.

(21) Appl. No.: 17/049,715

(22) PCT Filed: Apr. 18, 2019

(86) PCT No.: PCT/EP2019/060204
§ 371 (c)(1),
(2) Date: Oct. 22, 2020

(87) PCT Pub. No.: WO2019/206826
PCT Pub. Date: Oct. 31, 2019

(65) Prior Publication Data

US 2021/0238721 A1 Aug. 5, 2021

(30) Foreign Application Priority Data

Apr. 24, 2018 (EP) ..... 18169106

(51) Int. Cl.
*C22F 1/043* (2006.01)
*C22C 21/02* (2006.01)

(52) U.S. Cl.
CPC ..... *C22F 1/043* (2013.01); *C22C 21/02* (2013.01)

(58) Field of Classification Search
CPC ..... C22C 21/00; C22C 21/02; C22C 21/04; C22C 21/06; C22C 21/08; C22C 21/12; C22C 21/14; C22C 21/16; C22C 1/026; C22C 1/0416; C22F 1/04; C22F 1/043; C22F 1/047; C22F 1/05; C22F 1/057; B22D 11/003; B60R 2019/182
USPC ..... 148/550
See application file for complete search history.

(56) References Cited

U.S. PATENT DOCUMENTS

| | | | | |
|---|---|---|---|---|
| 11,479,838 | B2 * | 10/2022 | Skubich | C22C 21/16 |
| 2010/0059151 | A1 | 3/2010 | Iwamura et al. | |
| 2012/0168045 | A1 | 7/2012 | Ihara et al. | |
| 2013/0202477 | A1 * | 8/2013 | Zajac | B22D 25/06 164/122 |
| 2016/0304994 | A1 | 10/2016 | Skubich et al. | |
| 2017/0306465 | A1 | 10/2017 | Skubich et al. | |

FOREIGN PATENT DOCUMENTS

| | | | | |
|---|---|---|---|---|
| CA | 2 981 236 | A1 | 1/2018 | |
| EP | 0 687 743 | A1 | 12/1995 | |
| EP | 0 997 547 | A1 | 5/2000 | |
| EP | 2563944 | A1 | 3/2013 | |
| EP | 2841611 | A1 | 3/2015 | |
| EP | 2 883 973 | A1 | 6/2015 | |
| EP | 2993244 | A1 | 3/2016 | |
| JP | 2003181530 | A * | 7/2003 | |
| WO | 2011134486 | A1 | 11/2011 | |
| WO | 2013162374 | A1 | 10/2013 | |
| WO | 2016034607 | A1 | 3/2016 | |
| WO | WO-2016202810 | A1 * | 12/2016 | C22C 21/02 |

OTHER PUBLICATIONS

PCT International Search Report for PCT/EP2019/060204, mailed May 20, 2019.
Shi, et al., "Analysis of roping in an AA6111 T4P automotive sheet in 3D deformation states," Acta Materialia, (2017), vol. 124: 598-607.
Chakrabarti, et al., "Precipitation In Al—Mg—Si Alloys with Cu Additions and the Role of the Q' and Related Phases," Materials Science Forum, (2002), andrew.cmu.edu—precipitation in AlMgSi alloys with Cu additions and the role of the Q' and related phases.

* cited by examiner

*Primary Examiner* — Brian D Walck
*Assistant Examiner* — Danielle Carda
(74) *Attorney, Agent, or Firm* — McBee Moore & Vanik IP, LLC

(57) ABSTRACT

The invention relates to an extruded product made of 6xxx aluminium alloy comprising 0.40-0.80 wt. % Si, 0.40-0.80 wt. % Mg, 0.40-0.70 wt. % Cu, up to 0.4 wt. % Fe, up to 0.30 wt. % Mn, up to 0.2 wt. % Cr, up to 0.2 wt. % V, up to 0.14 wt. % Zr, up to 0.1 wt. % Ti, up to 0.05 wt. % each impurity and total 0.15 wt. %, remainder aluminum, wherein the ratio $Mg/Si_{free}$ is between 0.8 and 1.2 where $Si_{free}$ is calculated according to the equation $Si_{free}=Si-0.3*(Mn+Fe)$ where Si, Mn and Fe correspond to the content in weight % of Si, Mn and Fe of said 6xxx aluminum alloy and to the corresponding extruded product particularly suitable with a tensile yield strength higher than 280 MPa, and excellent crash properties. The invention also relates to the manufacturing process to obtain such extruded product.

18 Claims, 4 Drawing Sheets

6XXX ALUMINUM ALLOY FOR EXTRUSION WITH EXCELLENT CRASH PERFORMANCE AND HIGH YIELD STRENGTH AND METHOD OF PRODUCTION THEREOF

CROSS-REFERENCE TO RELATED APPLICATIONS

This application is the National Stage entry of International Application No. PCT/EP2019/060204, filed 18 Apr. 2019, which claims priority to European Patent Application No. 18169106.4, filed 24 Apr. 2018.

BACKGROUND

Field

Field of the Invention

The invention relates to a 6xxx aluminium alloy and the corresponding extruded product particularly suitable for manufacturing automotive, rail or transportation structural components with excellent crash performance, such as crash management systems, which should have simultaneously high mechanical properties, typically a tensile yield strength higher than 280 MPa, and preferably higher than 300 MPa and excellent crash properties. The invention also relates to the method for producing such extruded product.

Description of Related Art

The automotive industry continually increases the requirements for extruded products. Typical challenges include increasing mechanical and dynamic properties of crash alloys for safety components, such as crash box. However, it is well known that higher strength materials have lower elongation, thus a higher tendency to fracture and a lower crash performance.

AA 6008 aluminium alloys is now commonly used for crash absorber components for automotive application. It exhibits a minimum yield strength of 240 MPa, with typical values between 250 MPa to 280 MPa and good behavior to crash. However, it is expected to find solutions permitting to achieve higher yield strength, higher than 280 MPa with a similar behavior in crash.

In order to achieve high tensile yield strength, typically higher than 280 MPa, while retaining high crash performance with 6xxx alloys, some technical solutions have been suggested. One of them is a process described in EP 2993244, where the applied 6xxx-series aluminium alloy comprises Si 0.3-1.5 wt. %, Fe 0.1-0.3 wt. %, Mg 0.3-1.5 wt. %, Cu<1.5 wt. %, Mn<1.0 wt. %, Zr<0.2 wt. %, Cr<0.4 wt. %, Zn<0.1 wt. %, Ti<0.2 wt. %, V<0.2 wt. %, the rest being aluminium and inevitable impurities.

EP 2563944 also describes conditions for enabling production of a wrought aluminium material with improved damage tolerance while preserving the high strength of the material. A preferred composition according to EP 2563944 is given by an aluminium alloy comprising the alloying elements, in wt. %: Si 0.3 to 1.5, Mg 0.3 to 1.5, Cu<0.5, Mn<0.6, Nb<0.3, V<0.3, Ti<0.2, Mo<0.2, Cr<0.3, Zr<0.2, Zn<0.2, Fe<0.5, and inevitable impurities each<0.05, total<0.15, and balance aluminium.

EP2841611 discloses an extrudeable Al—Mg—Si aluminium alloy with improved strength, corrosion resistance, crush properties and temperature stability, in particular useful in or close to the front part of vehicles. The composition of the alloy is defined within the following coordinate points of an Mg—Si diagram: a1-a2-a3-a4, where in wt % a1=0.60 Mg, 0.65Si, a2=0.90 Mg, 1.0Si, a3=1.05 Mg, 0.75Si and a4=0.70 Mg, 0.50Si and where the alloy has a non-recrystallised grain structure in the extruded profile containing in addition the following alloy components in wt %: Fe up to 0.30, Cu 0.1-0.4, Mn 0.4-1.0, Cr up to 0.25 Zr up to 0.25 and Ti 0.005-0.15 incidental impurities up to 0.1 each and including Zn up to 0.5 with balance Al.

US2012/0168045 relates to an Al—Mg—Si aluminum alloy extrudate excellent in bending crush resistance and to a method for manufacturing the same. This Al—Mg—Si aluminium alloy contains in terms of mass %0.60-1.20% Mg, 0.30-0.95% Si, 0.01-0.40% Fe, 0.30-0.52% Mn, 0.001-0.65% Cu and 0.001-0.10% Ti and in which the contents of Mg and Si satisfy Mg (%)-(1.73-Si (%)-0.25)≥0 and the remainder comprises Al.

The problem to be solved is to propose an Al—Mg—Si alloy which has a high tensile yield strength, typically higher than 280 MPa, preferably higher than 300 MPa and at the same time a good crush properties, a good corrosion resistance, and a good thermal stability while maintaining a good extrudability and aptitude to bending. The alloy is developed for extruded products, however, it may be used for additional purposes (e.g. forging of cast billets).

In general, an alloy is considered as offering good crush properties if the deformation of the profile occurs in a controlled and defined way. The profile has to exhibit periodic folds without any disruption during deformation. It is possible to evaluate this property by applying an axial force parallel to extrusion direction on a hollow extrusion, measuring the force and the displacement during the test and evaluating cracks appearance during folding. Depending on the crack appearance, their length and the number of folding, a crash index is evaluated and permits to rank different alloys and/or process solutions to crushability. This method is presented in EP2993244. This test is very dependent on the chosen hollow extrusion geometry. An alternative is to use the three points bending test which is a classical experiment in mechanics, used to measure the mechanical behavior of a material in the shape of a beam, independently of any extrusion geometry. The beam, of length L, rests on two roller supports and is subject to a concentrated load F at its center. The VDA 238.100 testing conditions can be used to evaluate the forming behavior and the susceptibility to failure of metallic materials during forming processes dominated by bending deformation (e.g. folding operations) or during crash deformation. It permits to measure the maximum angle for a given bending radius and to measure the absorbed energy for a given intrusion deformation. The maximum angle gives also a good estimate on the propensity of the material to present cracks during folding. Higher bending angle, lower susceptibility for crack occurrence.

Unless otherwise stated, all information concerning the chemical composition of the alloys is expressed as a percentage by weight based on the total weight of the alloy. "6xxx aluminium alloy" or "6xxx alloy" designate an aluminium alloy having magnesium and silicon as major alloying elements. "AA6xxx-series aluminium alloy" designates any 6xxx aluminium alloy listed in "International Alloy Designations and Chemical Composition Limits for Wrought Aluminium and Wrought Aluminium Alloys" published by The Aluminium Association, Inc. Unless otherwise stated, the definitions of metallurgical tempers listed in the European standard EN 515 will apply. Static tensile mechanical characteristics, in other words, the ultimate tensile strength UTS (or Rm), the tensile yield strength at 0.2% plastic elongation YS (or Rp0,2), and elongation A % (or E %), are determined by a tensile test according to NF EN ISO 6892-1. Unless otherwise stated, energy absorption is determined by a three point points bending test, performed according to VDA 238-100 standard with no pre strained before testing and a rectangular material coupon whose width is maximized to minimize influence of triaxial stress conditions in the area of the edges while avoiding intercepting an inner reinforcement wall if a hollow extrusion is tested. The punch with a blade of radius r is pushing on the test coupon so the fold axis being normal to the extrusion direction.

The maximum bending angle is determined by bending, normally to the direction of the extrusion, a coupon according to VDA 238-100. Bending is performed until first crack is observed. The bending angle corresponds to the angle α at which first crack appears as represented at FIG. 1. Angle α corresponds to the complementary angle β, measured between the two parts $P_a$ and $P_b$ of the coupon 2. Bending angle is dependent on the thickness of the coupon. To permit to rank products, it is of interest to use a corrected angle α' corresponding to the estimated angle for a $e_{ref}$ thick coupon according to the following formula:

$$\alpha' = \alpha \frac{\sqrt{e}}{\sqrt{e_{ref}}}$$

where e corresponds to the thickness of the tested coupon and $e_{ref}$ corresponds to the reference thickness.

SUMMARY OF THE INVENTION

The present invention relates to an extruded product made of 6xxx alloy according to the invention which comprises 0.40-0.80 wt. % of Si, 0.40-0.80 wt. % Mg, 0.40-0.70 wt. % Cu, up to 0.4 wt. % Fe, up to 0.30 wt. % Mn, up to 0.2 wt. % Cr, up to 0.2 wt. % V, up to 0.14 wt. % Zr, up to 0.1 wt. % Ti, up to 0.05 wt. % each impurity and 0.15 wt. % total, remainder aluminum, wherein the $Mg/Si_{free}$ is comprised between 0.8 and 1.2 where $Si_{free}$ is calculated according to the equation $Si_{free}=Si-0.3*(Mn+Fe)$, where Si, Mn and Fe correspond to the content in weight % of Si, Mn and Fe of said 6xxx aluminum alloy.

In a preferred embodiment, the Cu content is from 0.45 to 0.70 wt. %, preferably from 0.50 to 0.70 wt. %, more preferably from 0.60 to 0.70 wt. %.

In a preferred embodiment, the Mn content is lower than 0.1 wt. %, preferably lower than 0.10 wt. %, and more preferably lower than 0.05 wt. %.

In a preferred embodiment, the Cr content is lower than 0.1 wt. %, preferably lower than 0.10 wt. % and more preferably lower than 0.05 wt. %.

In a preferred embodiment, the Zr content is lower than 0.10 wt. %, preferably lower than 0.07 wt. %, and more preferably lower than 0.05 wt. %.

In a preferred embodiment, the V content is lower than 0.1 wt. %, preferably lower than 0.07 wt. % and more preferably lower than 0.05 wt. %.

The extruded product according to the invention presents a fraction of (Al, Si, Mg, Cu) type precipitates, with a dimension higher than 100 nm, higher than 5%, more preferably comprised between 5 to 20%, more preferably between 5 to 10%, when observed in TEM bright-field mode according to <001> zone axis direction.

Said extruded product according to the invention presents a tensile yield strength measured in the extrusion direction equal or higher than 280 MPa, and more preferably higher than 300 MPa and a bending angle higher than $113/\sqrt{e}$ °, angle measured on a coupon of 60 mm×60 mm×e according to VDA238-100 using a bending radius of 0.4 mm, where e is the thickness of the coupon in mm. The value of $113/\sqrt{e}$ ° is equivalent to obtain a bending angle higher than 80° measured according to VDA238-100 standard using a bending radius of 0.4 mm, said bending angle of 80° is given for an equivalent thickness of 2 mm.

Another aim of the invention is a method for producing the extrusion product with a good compromise between strength, crashworthiness and corrosion resistance.

Said method comprises the following steps:

a) casting a billet from a 6xxx aluminium alloy,
b) homogenizing said cast billet
c) heating said homogenised cast billet;
d) extruding said heated billet through a die to form an extruded product;
e) quenching said extruded product down to room temperature;
f) Natural Ageing less than 100 days at room temperature said quenched product
g) Artificial ageing said natural aged product to T6 or T7 temper;

wherein said 6xxx aluminium alloy comprises 0.40-0.80 wt. % Si, preferably 0.40-0.70 wt. % Si, 0.40-0.80 wt. % Mg, preferably 0.40-0.70 wt. % Mg, 0.40-0.70 wt. % Cu, up to 0.4 wt. % Fe, up to 0.30 wt. % Mn, up to 0.2 wt. % Cr, up to 0.2 wt. % V, up to 0.14 wt. % Zr, up to 0.1 wt. % Ti, up to 0.05 wt. % each impurity and 0.15 wt. % total, remainder aluminum and wherein the ratio $Mg/Si_{free}$ is between 0.8 and 1.2 where $Si_{free}$ is calculated according to the equation $Si_{free}=Si-0.3*(Mn+Fe)$ where Si, Mn and Fe correspond to the content in weight % of Si, Mn and Fe of said 6xxx aluminum alloy.

In a preferred embodiment, natural ageing treatment of step f) is less than 24 h, preferably less than 12 h, more preferably less than 2 h, even more preferably less than 1 hour.

In another preferred embodiment, said heating step c) is a solution heat treatment wherein:

c1) said homogenised billet is heated to a temperature between Ts-60° C. and Ts, wherein Ts is the solidus temperature of said 6xxx aluminium alloy;
c2) said heated billet is quenched until its mean temperature reaches a value between 400° C. and 480° C. while ensuring that said billet surface temperature never goes below about 400° C.; said quenched billet is immediately extruded (step d) after the end of step c2).

In another preferred embodiment, said artificial ageing treatment of step g) consists in at least three steps, which are successively j) an artificial preageing treatment step with a duration t1 at a temperature T1 selected to increase the yield strength by 5% to 20%, preferably by 6% to 19%, and more preferably by 8% to 18% compared to the yield strength obtained after step f), said temperature T1 being typically between 120° C. and 180° C. and said duration t1 being typically between 1 and 100 hours, to obtain an artificially preaged extrusion,
jj) a plastic deformation step of said artificially preaged extrusion between 1% and 80% to obtain a deformed extrusion,
jjj) a final artificial ageing treatment step of said deformed extrusion with a duration t2 at a temperature T2, said temperature T2 being typically between 140° C. and 200° C. and said duration t2 being typically between 1 and 100 hours.

Another aim of the invention is the use of said extrusion in automotive application, either as an automotive crash component, like a crash box or for body in white application or battery box in electrical vehicles.

DESCRIPTION

Figure 1:
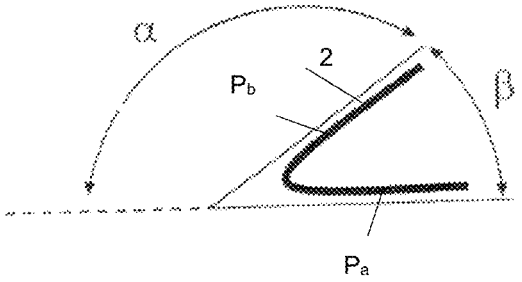
FIG. 1 represents the definition of the bending angle.

The 6xxx alloy according to the invention comprises 0.40-0.80 wt. % of Si, 0.40-0.80 wt. % Mg, 0.40-0.70 wt. % Cu, up to 0.4 wt. % Fe, up to 0.30 wt. % Mn, up to 0.2 wt. % Cr, up to 0.2 wt. % V, up to 0.14 wt. % Zr, up to 0.1 wt. % Ti, up to 0.05 wt. % each impurity and 0.15% total, remainder aluminum, wherein the $Mg/Si_{free}$ is comprised between 0.8 and 1.2 where $Si_{free}$ is calculated according to the equation $Si_{free}=Si-0.3*(Mn+Fe)$, where Si, Mn and Fe correspond to the nominal composition in weight % of Si, Mn and Fe.

Silicon (Si) content is from 0.40 wt. % to 0.80 wt. %. The Si content is preferably from 0.40 wt. % to 0.70 wt. % and more preferably from 0.50 wt. % to 0.70 wt. %. Silicon (Si) as well as Mg is an essential element which contributes to solid solution strengthening and forms aging precipitates after artificial ageing. In order to obtain an adequate level of strength, Si is higher than 0.40 wt. %, preferably higher than 0.50 wt. %. Si content has to be lower than 0.80 wt. %, preferably lower than 0.70 wt. % to have an alloy easy to be extruded.

Magnesium (Mg) content is from 0.40 wt. % to 0.80 wt. %. The Mg content is preferably from 0.40 wt. % to 0.70 wt. % and more preferably from 0.40 wt. % to 0.60 wt. %. In order to obtain an adequate level of strength, Mg is higher than 0.40 wt. %. Mg content has to be lower than 0.80 wt. %, preferably, Mg is lower than 0.70 wt. % and more preferably lower than 0.60 wt. % to have an alloy easy to be extruded.

Mg and Si contents are chosen in order to have a $Mg/Si_{free}$ comprised between 0.8 and 1.2. $Si_{free}$ is calculated according to the equation $Si_{free}=Si-0.3*(Mn+Fe)$, where Si, Mn and Fe correspond to the content in weight % of Si, Mn and Fe. The ratio $Mg/Si_{free}$ is preferably higher than 0.8 to reduce Si content in solid solution. It permits to obtain a long term thermal stability. Preferably, the ratio $Mg/Si_{free}$ is lower than 1.2 to have an alloy easy to be extruded.

Copper (Cu) contributes to improve strength through solid solution strengthening, but also by precipitate age hardening after artificial ageing. The inventors discovered that by adjusting the level of Cu to a value from 0.40 wt. % to 0.70 wt. %, the level of strength is increased while maintaining the aptitude to crush and bending. This unexpected effect is attributed to the ability of Cu after artificial ageing for forming (Al, Mg, Si, Cu) precipitates with a main growth direction according to <001> Al longer than 100 nm.

According to the invention, Cu is preferably higher than 0.45 wt. %, more preferably higher than 0.50 wt. % and more preferably higher than 0.60 wt. % to obtain sufficient strength and good properties of crush. Maximum content of Cu is 0.70 wt. % to achieve a good corrosion resistance. Preferably, Cu content is from 0.45 to 0.70 wt. %, preferably from 0.50 to 0.70 wt. %, more preferably from 0.60 to 0.70 wt. %.

Manganese (Mn) increases strength either in solid solution or as a finely precipitated intermetallic phase. It permits also to control the grain structure. According to the invention, Mn content is lower than 0.30 wt. %, preferably lower than 0.1 wt. %, preferably lower than 0.10 wt. % and more preferably lower than 0.05 wt. % to maintain a recrystallized structure and a good extrudability. Preferably Mn content is from 0.05 wt. % to 0.30 wt. %, preferably from 0.05 wt. % to 0.1 wt. %, more preferably from 0.05 wt. % to 0.10 wt. % to maintain a recrystallized structure.

Chromium (Cr) increases strength either in solid solution or as a finely precipitated intermetallic phase. It permits also to control the grain structure. According to the invention, Cr content is lower than 0.2 wt. %, preferably lower than 0.1 wt. %, and more preferably lower than 0.10 wt. % and more preferably lower than 0.05 wt. % to maintain a recrystallized structure and a good extrudability. Preferably Cr content is from 0.05 wt. % to 0.2 wt. %, preferably from 0.05 wt. % to 0.1 wt. %, more preferably from 0.05 wt. % to 0.10 wt. % to maintain a recrystallized structure.

Vanadium (V), in a lesser extent than titanium or zirconium is a grain refining upon solidification. It permits also to control the grain structure. According to the invention, V content is lower than 0.2 wt. %, preferably lower than 0.1 wt. %, more preferably lower than 0.10 wt. %, more preferably lower than 0.07 wt. % and even more preferably lower than 0.05 wt. % to maintain a recrystallized structure. Preferably V content is from 0.05 wt. % to 0.2 wt. %, more preferably from 0.05 wt. % to 0.1 wt. %, even more preferably from 0.05 wt. % to 0.10 wt. % to maintain a recrystallized structure.

Zirconium (Zr) additions are used to reduce the as cast grain size, but its effect is less than that of titanium. It also permits to control the grain structure by forming fine precipitates of intermetallic particles that inhibit recovery and recrystallization. Zr content is lower than 0.14 wt. %, preferably lower than 0.10 wt. % and more preferably lower than 0.07 wt. % and even more preferably, Zr content is lower than 0.05 wt. % to maintain a recrystallized structure. Preferably Zr content is from 0.05 wt. % to 0.14 wt. %, more preferably from 0.05 wt. % to 0.10 wt. % to maintain a recrystallized structure.

Titanium (Ti) is added as a grain refiner during casting. Its effect is enhanced if Boron is present in the melt or if it is added as a master alloy containing Boron, combined as $TiB_2$. Ti content is lower than 0.1 wt. %. Preferably, Ti content is from 0.005 wt. %. to 0.1 wt. %.

Although iron (Fe) is generally an impurity and its content should be maintained with a maximum content of 0.4%, preferably 0.3%, it may be added intentionally in some extent to promote recrystallization with a level of at least 0.01 wt. %, preferably 0.05% but in a level extending not more than a maximum level of 0.4% preferably 0.3%.

Impurities are elements that are not added intentionally. According to the invention, impurities, other than Fe, have preferably a maximum content of 0.05 wt. % each and 0.15 wt. % total.

The 6xxx alloy is particularly well suited for being transformed as extrusions. Said extrusions are well used for being implemented into automotive application demanding compromise between strength and crush properties. In particular, extrusions produced with the 6xxx alloy according to the invention are particularly well suited for being used as automotive crash component, like crash boxes, but also in body in white application or battery box or battery enclosure to insure structural integrity of electrical modules.

The use of extrusions made of the 6XXX alloy according to the invention presents also an interest for recyclability and green impact environment, due to its aptitude to sustain high Fe content, up to 0.4%.

The extruded product presents an essentially recrystallized grain structure, preferably an equiaxed recrystallized grain structure. Within the framework of the invention, an essentially recrystallized grain structure refers to a grain structure such that the recrystallization_fraction is greater than 70%, and preferably greater than 90%. The recrystallization fraction is defined as the area fraction on a metallographic section occupied by recrystallized grains. According to ASTM E112-12 the anisotropy index is between 1 to 2 in a cross section containing the extrusion direction. Mean grain size is preferably between 80 μm to 350 μm, more preferably between 100 μm to 250 μm. The ASTM grain size number measured according to ASTM E112-12 standard is preferably comprised between 2 to 6, more preferably between 2 to 5. Extrema values being included into the preferred ranges.

The extruded product according to the invention presents a tensile yield strength measured in the extrusion direction equal or higher than 280 MPa, and more preferably higher than 300 MPa and a bending angle higher than $113/\sqrt{e}$ °, angle measured on a coupon of 60 mm×60 mm×e according to VDA238-100 using a bending radius of 0.4 mm, where e is the thickness of the coupon in mm. The value of $113/\sqrt{e}$° is equivalent to obtain a bending angle higher than 80° measured according to VDA238-100 standard using a bending radius of 0.4 mm, where said bending angle of 80° is given for an equivalent thickness of 2 mm. Indeed, it is of interest to use a corrected angle obtained on a given thickness coupon. The reference coupon is here chosen at 2 mm. According to the definition of the corrected angle α', $$\alpha' = \alpha \frac{\sqrt{e}}{\sqrt{e_{ref}}}$$

a corrected angle obtained on a on coupon 2 mm thick higher than 80° corresponds to an angle α higher than $113/\sqrt{e}$ ° measured on a coupon with a thickness e ($113=80*\sqrt{2}$).

The inventors found to achieve a yield strength higher than 280 MPa, preferably higher than 300 MPa and a good behavior in crash, in particular with a corrected bending angle higher than 80° according to VDA 238-100 and cracks smaller than 10 mm after a quasistatic crush test, the extrusion made of a 6xxx alloy according to the invention presents a microstructure with (Al,Si,Mg,Cu) type precipitates with a dimension longer than 100 nm whose fraction is higher than 5%, preferably comprised between 5% to 20%, more preferably between 5% to 10%, when observed in TEM bright field mode according to <001> zone axis direction. Said <001> zone axis direction corresponds to the zone axis direction of the aluminum matrix in TEM bright field images. (Al,Si,Mg,Cu) type precipitates or Al $Si_x$ $Mg_y$ $Cu_z$, precipitates with x,y as strictly positive real numbers and z as positive real are precipitates containing aluminium, silicon, magnesium and copper. The values of x, y and z can vary with the chemical composition of selected 6xxx alloy composition and artificial ageing conditions.

The crystal structure of (Al,Si,Mg,Cu) type precipitates or Al $Si_x$ $Mg_y$ $Cu_z$, precipitates can also vary with the chemical composition of selected 6xxx alloy composition and artificial ageing conditions. Chakrabarti et al. in Materials Science 49 (2004) 389-410 "Phase relations and precipitation in Al—Mg—Si alloys with Cu additions" discuss the possible existing phases in Al—Mg—Si—Cu ternary alloys. In particular, in Al—Mg—Si—Cu quaternary alloys, it is cited the possible existing phases which correspond to (Al,Si,Mg,Cu) type precipitates in the invention: needle shaped β" phases with a monoclinic structure, the lath shaped hexagonal precursor phases Q', the hexagonal QP or QC, the stable equilibrium phase Q with an hexagonal structure, β phases with a face centered cubic structure. Typically, Q, Q', QP, QC phases contains Cu and β and β" have no Cu.

Figure 3:
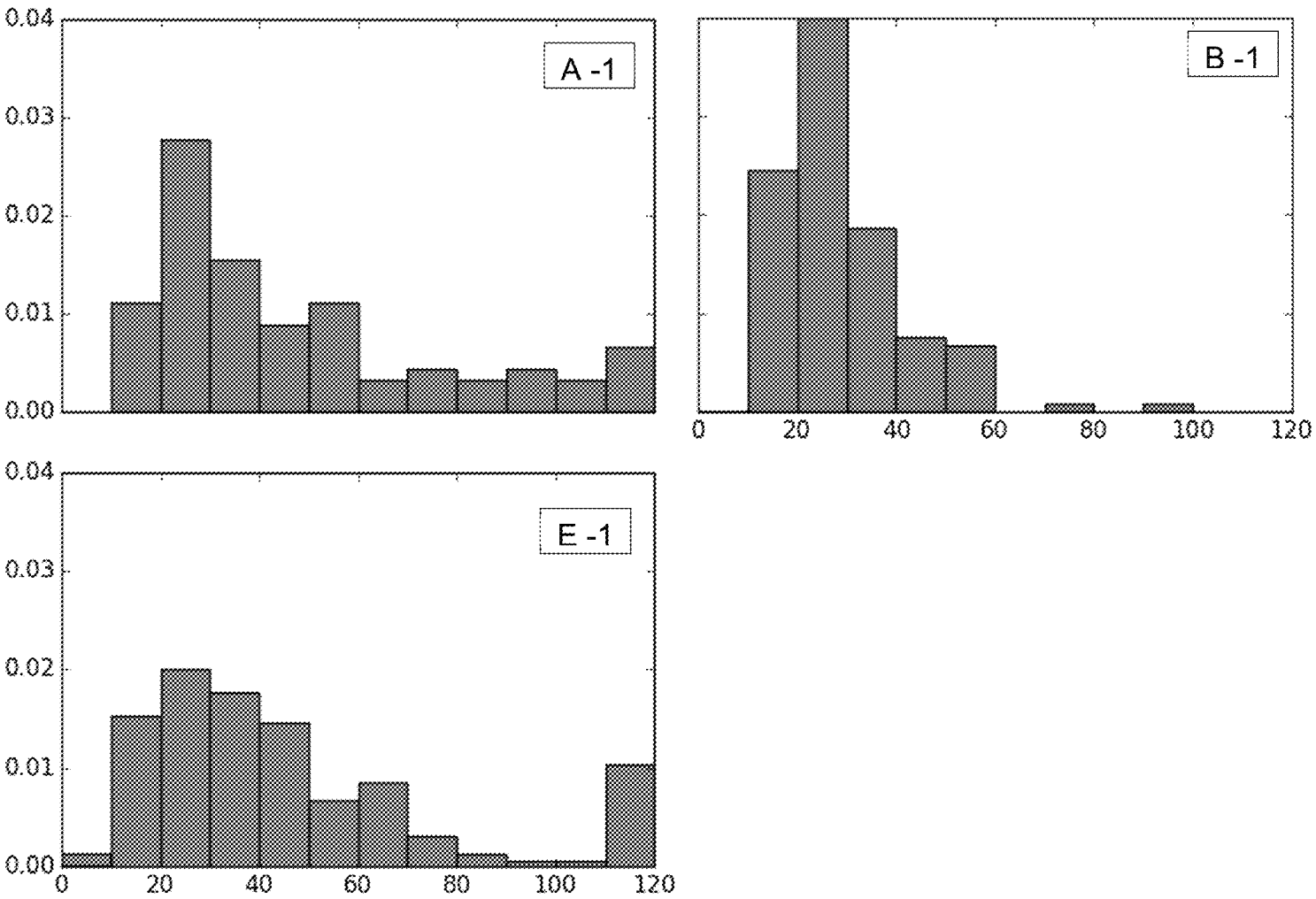
FIG. 3 and FIG. 4 represents the measured distribution in size of some tested samples according to example 1 and 2. The fraction is plotted versus a size dimension range.
Figure 4:
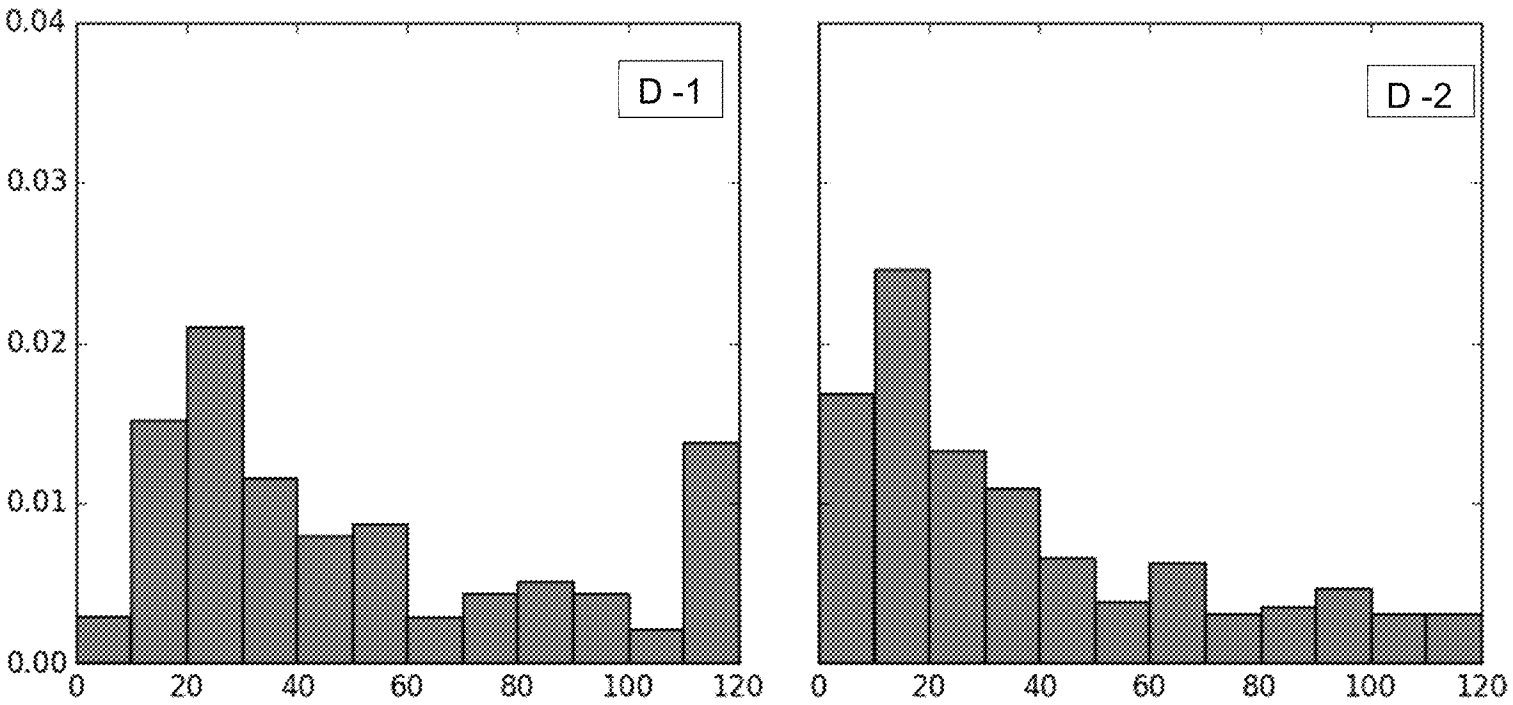

The method for characterizing the microstructure of the extruded products (including precipitate morphology and dimension distribution) is using transmission electron microscopy (TEM). (Al,Si,Mg,Cu) type precipitates, depending on the chemical composition of selected 6xxx alloy composition and artificial ageing conditions, have needle/lath/rod/plate morphologies with a main growth dimension along <001>, <100> or <010> directions. To determine dimensions of said (Al,Si,Mg,Cu) precipitates, TEM specimen is preferably oriented in one of these zone axis <001>, <100> or <010>. For instance, the zone axis <001> permits to observe the main growth <100> or <010> directions of (Al,Si,Mg,Cu) precipitates. Said main growth <100> or <010> directions is a dimension of said (Al,Si, Mg,Cu) precipitates and can be also considered as the length of said (Al,Si,Mg,Cu) precipitates. Images recorded in bright field TEM are used for finding precipitate number density and measuring dimension of precipitates, such as length. The fraction of (Al, Si, Mg, Cu) type precipitates with a dimension higher than 100 nm is determined by counting each precipitates of given dimension, rank precipitates within given dimensions, typically lower than 100 nm and higher than 100 nm and make the ratio between the number of precipitates with a dimension higher than 100 nm with the total number of counted precipitates. It is also possible to rank precipitates in narrower dimension range, typically between 0 to 10 nm, 10 to 20 nm, 20 to 30 nm . . . like it is represented in FIG. 3 or 4.

Samples are prepared by cutting 3 mm discs; samples are preferably taken at mid-thickness section of the extrusion, parallel to the extrusion direction.

To quantify the fraction of precipitates having a dimension longer than 100 nm, samples are oriented such that the aluminium matrix is aligned to the <001> zone axis, and imaged in bright-field mode. The precipitate dimension distribution is preferably measured by imaging at 30,000-50,000× magnification.

In a preferred embodiment, the microstructure presents (Al,Si,Mg,Cu) precipitates with an average length comprised from 30 to 70 nm, preferably from 30 nm to 60 nm. The standard deviation of the average length distribution is from 30 to 50 nm. In a more preferred embodiment, the microstructure presents (Al,Si,Mg,Cu) precipitates with an average length comprised from 35 to 45 nm and a standard deviation from 30 nm to 50 nm.

Preferably, the extruded product contains (Al,Si,Mg,Cu) type (Al,Si,Mg,Cu) type precipitates with a dimension longer than 100 nm whose fraction is higher than 5%, preferably comprised between 5% to 20%, more preferably between 5% to 10%, when observed in TEM bright field mode according to <001> zone axis direction.

The inventors attributes the good behavior in crush to the presence of (Al,Si,Mg,Cu) type precipitates with a dimension longer than 100 nm whose fraction is higher than 5%, preferably comprised between 5% to 20%, more preferably between 5% to 10%, when observed in TEM bright field mode according to <001> zone axis direction.

Preferably (Al,Si,Mg,Cu) type precipitates with a dimension longer than 100 nm has a dimension comprised between 100 nm to 1000 nm, more preferably between 100 nm to 500 nm and even more preferably between 100 nm to 200 nm.

Preferably, (Al,Si,Mg,Cu) type precipitates with a dimension comprised between 100 nm to 1000 nm has a fraction higher than 5%, preferably comprised between 5% to 20%, more preferably between 5% to 10%, when observed in TEM bright field mode according to <001> zone axis direction.

(Al,Si,Mg,Cu) type precipitates with a dimension longer than 100 nm correspond in part to hardening precipitates formed during final artificial ageing. Some may also be formed during quenching.

In a preferred embodiment, (Al,Si,Mg,Cu) type precipitates with a dimension longer than 100 nm correspond to hardening precipitates formed during final artificial ageing.

In a preferred embodiment, (Al,Si,Mg,Cu) type precipitates with a dimension comprised between 100 nm to 500 nm and with a fraction higher than 5%, preferably comprised between 5% to 20%, more preferably between 5% to 10%, when observed in TEM bright field mode according to <001> zone axis direction are hardening precipitates.

The method for manufacturing the 6xxx extrusion according to the present invention comprises a casting step for preparing a billet from the 6xxx aluminium alloy according to the invention.

The cast billet comprises the following element 0.40-0.80 wt. % of Si, 0.40-0.80 wt. % Mg, 0.40-0.70 wt. % Cu, up to 0.4 wt. % Fe, up to 0.30 wt. % Mn, up to 0.2 wt. % Cr, up to 0.2 wt. % V, up to 0.14 wt. % Zr, up to 0.1 wt. % Ti, up to 0.05 wt. % each impurity and 0.15% total, remainder aluminum wherein the ratio $Mg/Si_{free}$ is between 0.8 and 1.2 where $Si_{free}$ is calculated according to the equation $Si_{free}=Si-0.3*(Mn+Fe)$ where Si, Mn and Fe correspond to the content in weight % of Si, Mn and Fe of said 6xxx aluminum alloy.

In a preferred embodiment, the cast billet comprises any preferred content of elements. Already described.

In another preferred embodiment, the cast billet comprises the following element 0.40-0.80 wt. % of Si, 0.40-0.80 wt. % Mg, 0.40-0.70 wt. % Cu, up to 0.4 wt. % Fe, up to 0.1 wt. % Mn, up to 0.1 wt. % Cr, up to 0.1 wt. % V, up to 0.10 wt. % Zr, up to 0.1 wt. % Ti, up to 0.05 wt. % each impurity and 0.15% total, remainder aluminum wherein the ratio $Mg/Si_{free}$ is between 0.8 and 1.2 where $Si_{free}$ is calculated according to the equation $Si_{free}=Si-0.3*(Mn+Fe)$ where Si, Mn and Fe correspond to the content in weight % of Si, Mn and Fe of said 6xxx aluminum alloy.

The cast billet is then subjected to a homogenizing step followed by cooling to room temperature. The homogenization consists in heating the billet at a temperature between 485° C. and lower than the liquidus temperature for a duration between 1 h and 12 h. Preferably the temperature range is chosen between 550° C. to 585° C. The homogenization aims to improve the workability of the cast billet by homogenizing the structure, in particular by dissolving the segregations induced by casting and/or by precipitating intermetallic phases and/or spheroidizing insoluble iron rich precipitates. Homogenizing at a temperature lower than 485° C. may fail to obtain a satisfying extrudability of the billet.

The homogenized billet is then heated and subsequently extruded to form an extrusion.

In one embodiment, the heating step before extrusion consists in a pre-heating of the cast billet, between 410° C. and 530° C. during a period of less than 1 hour, before performing subsequently the extrusion step.

In one other embodiment, the heat treating step consists in a solution heat treating step, before performing the extrusion step. It consists in a soaking step at a temperature between Ts-60° C. and Ts, wherein Ts is the solidus temperature of the said 6xxx aluminium alloy and quenching the billet until billet mean temperature reaches a value between 400° C. and 480° C. while ensuring billet surface never goes below a temperature substantially close to 400° C. before performing the extrusion step. The quenched billet is then extruded. The extrusion is performed immediately after the step of quenching. Immediately corresponds typically to a time period between 1 second to 2 minutes. This time period has to be limited to avoid that the surface temperature of the billet goes below 400° C. Quenching step is preferably performed by water spraying.

This method is presented in EP2883973. Its content is introduced here by reference. Method of EP2883973 was initially proposed to maximize strength at more than 380 MPa on fibrous microstructures of 6xxx alloys. Surprisingly, the inventors found that applying the same method to a 6xxx alloy with the specific composition according to the invention permits to obtain a higher strength and at the same time an excellent aptitude to crush. This phenomenon was unexpected as it is commonly considered that increasing strength induces a decrease of crush properties.

The extrusion is preferably a hollow extrusion. The geometry of the cross section of said hollow extrusion is preferably suitable to obtain a good aptitude for crush. An example is presented at FIG. 2, which corresponds to a three chambers extrusion.

After the extrusion step, the extrusion is press quenched. Preferably, the extrusion is intensively cooled down by water spraying or immersion to obtain a satisfying yield strength and good crush properties after artificial ageing. The cooling rate is at least 50° C./s, more preferably higher than 100° C./s and even more higher than 120° C./s. With slower cooling rates, it is not possible to obtain a yield strength higher than 280 MPa and good bending angle.

The quenched extrusion is then naturally aged during less than 100 days. Natural ageing corresponds to properties changes at room temperature after quenching. It may start immediately after quenching or after an incubation period. Preferably, natural ageing period is less than 15 days, more preferably less than 48 h, more preferably less than 24 h, even more preferably less than 12 h and even more preferably less than 1 hour to obtain good crush properties. To permit to have a consistent process, it is preferable that the natural ageing is controlled and lasts more than 0.2 h. In a more preferred embodiment, the duration of natural ageing after quenching is between 0.2 h to 10 days, more preferably between 0.2 h to 24 h, more preferably between 0.2 h to 12 h and even more preferably between 0.2 h to 1 h.

At the end of the naturally aging step, the extrusion product is in a T4 temper.

The naturally aged extrusion is then artificially aged in a T6 or T7 temper.

The naturally aged extrusion is aged by a one or multiple-step(s) heat treatment at temperature(s) ranging from 150° C. to 200° C. for a prescribed period of time, between 1 to 100 hours.

In a preferred embodiment, the naturally aged product is aged according to a thermomechanical ageing, so called TMA which consists in three successive steps:

Step 1: an artificial preageing treatment is performed during a duration t1 at a temperature T1. Conditions t1 and T1 are selected to increase the yield strength by 5% to 20%, preferably by 6% to 19%, and more preferably by 8% to 18% compared to the yield strength of the extrusion after the end of the natural ageing step, ie corresponding to the T4 temper properties. The duration t1 and the temperature T1 of the preageing treatment are respectively typically between 15 min to 100 hours and 120° C. to 190° C. to obtain an artificially preaged extrusion.

Step 2: a plastic deformation of said artificially preaged extrusion is performed and corresponds to a plastic deformation between 1% to 80%, preferably between 1% to 50%, more preferably between 1% to 20, more preferably between 2% to 7% and even more preferably between 2% to 6%. Said plastic deformation is preferably obtained by stretching, or by in any others techniques such as hydroforming or pressing or stamping or bending or roll bending or stretch bending or rotary stretch bending or pulse magnetic forming or flow forming or forging or rolling or drawing or deep drawing or impact or inverse extrusion or punching or blanking. Said plastic deformation is preferentially performed at room temperature. In one preferred embodiment, said plastic deformation is applied uniformly on the said artificially preaged extrusion. In one other embodiment, said plastic deformation is applied locally on the said artificially preaged extrusion.

Step 3: a final artificial ageing treatment of said deformed extrusion with a duration t2 at a temperature T2 whose duration t2 and temperature T2 are selected to reach a maximum yield strength or an overaged temper. Preferably, final artificial ageing treatment is an overaged temper to obtain the good crashability performance. Typically said temperature T2 is between 140° C. to 200° C. and the duration t2 between 1 to 100 hours. Said final artificial ageing treatment may be performed in multiple steps. Multiple steps includes the ramp-up to reach the plateau temperature T2. This ramp up is possibly done by a progressive increase in temperature or by an intermediate plateau. In one embodiment, final artificial ageing is done in two steps with a first step at a temperature T3 and a duration t3 and a second step at a temperature T4 and a duration t4; temperature T3 being lower than temperature T4.

Preferably the artificial aging is such that the equivalent time t(eq) at 170° C. is between 1 h and 80 h, preferentially between 1 and 35 h and more preferably between 2 and 20 h.

Equivalent time t(eq) at 170° C. is defined by the formula:

$$T(\text{eq})=(\int\exp(-Q/RT')dt)/(\exp(-(Q/RT\text{ref})$$

where T' (in Kelvin) is the instantaneous treatment temperature, which changes with time t' (in hours), and Tref is a reference temperature set at 443 K (170° C.). t(eq) is expressed in hours, with the constant R=8.31 J/mol/K and the activation energy of the diffusion of Mg, Q=130400 J/mol. The formula giving t(eq) takes account of the heating and cooling phases.

This so called TMA method is presented in EP 3312301. Its content is introduced here by reference.

The invention will be better understood thanks to the examples described hereinafter, which are however not limiting.

All documents referred to herein are specifically incorporated herein by reference in their entireties.

As used herein and in the following claims, articles such as "the", "a" and "an" can connote the singular or plural.

EXAMPLES

Example 1

Different alloys were cast using DC-Cast technology to produce logs having a diameter of 152 mm. The chemical compositions of the alloys are listed in Table 1.

Alloys D to G have chemical composition according to the invention, which are characterized by Cu level above 0.4 wt. %; they all contain Cr, V and Zr at less than 0.1 wt. %.

TABLE 1

Chemical composition of investigated alloys (wt. %).

| Alloy | | Si | Fe | Cu | Mn | Mg | Ti | Mg/Si free | Tsolidus (° C.) |
|---|---|---|---|---|---|---|---|---|---|
| A | Compar. | 0.45 | 0.2 | — | — | 0.42 | 0.01 | 1.1 | |
| B | Compar. | 0.71 | 0.2 | 0.24 | 0.08 | 0.5 | <0.05 | 0.8 | 605 |
| C | Compar. | 0.65 | 0.2 | 0.25 | 0.08 | 0.57 | 0.04 | 1.0 | 607 |
| D | Invention | 0.54 | 0.2 | 0.44 | 0.07 | 0.49 | 0.04 | 1.0 | 611 |
| E | Invention | 0.64 | 0.2 | 0.61 | 0.07 | 0.54 | 0.04 | 1.0 | 599 |
| F | Invention | 0.59 | 0.2 | 0.58 | 0.07 | 0.55 | 0.04 | 1.1 | 602 |
| G | Invention | 0.60 | 0.2 | 0.68 | 0.07 | 0.54 | 0.04 | 1.0 | 600 |

Figure 2:
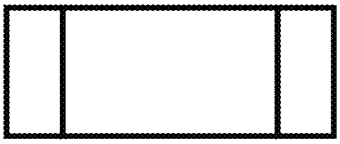
FIG. 2 represents an example of extrusion geometry presenting a good aptitude to crashability.

The logs were homogenized at a temperature of 575° C. for at least 4 h. The logs were then cut to obtain 600 mm long billets. Before extrusion, cut billets were submitted to a solutionizing heat treatment in an induction furnace to temperatures around 555° C. for 90 seconds and subsequently water quenched to 500° C. prior to be extruded on a direct extrusion press to form crash profiles as schematically shown in FIG. 2. The preheating temperature range is selected to achieve a soaking temperature between Ts-60 and Ts. The extruded profiles exited from the extrusion press at an extrusion speed around 10 m/min and were then water quenched.

The crash profiles, delivered in the as-quenched condition, were then slightly stretched for straightening (stretching ratio <1%) and submitted to an artificial ageing to the T7 condition (150° C./3 h+190° C./7 h).

The profiles obtained in the T7 condition were submitted to tensile testing, bending, and crash tests. The corresponding results are provided in Table 2.

Room temperature tensile tests were performed according to standard ASTM E 8/E 8M with non-proportional tensile specimen.

The bending angle was estimated by bending, normally to the direction of the extrusion, a coupon whose dimension is 60 mm×60 mm according to VDA 238-100, for a bending radius r equal to 0.4 mm. Bending is performed until first crack is observed. The bending angle corresponds to the angle α at which first crack appears as represented at FIG. 1. Angle α corresponds to the complementary angle β, measured between the two parts $P_a$ and $P_b$ of the coupon 2. Bending angle is dependent on the thickness of the coupon. To permit to rank products, it is of interest to use a corrected angle α' corresponding to the estimated angle for a $e_{ref}$ of 2 mm thick coupon according to the following formula:

$$\alpha' = \alpha \frac{\sqrt{e}}{\sqrt{e_{ref}}}$$

where e corresponds to the thickness of the tested coupon and $e_{ref}$ corresponds to the reference thickness, here taken at 2.0 mm.

The crashability was estimated by a quasistatic crush test performed in axial direction Three tests were performed for each case to assess the crack behavior of the extruded section. The length of each extrusion prior crash was set at 300 mm and the crash displacement was 200 mm long. The crashability is evaluated according to the ability of the product to exhibit cracks. Depending on their occurrence and corresponding length, an arbitrary crash index can be given. A "A" crash index corresponds to no crack observed, a "B" crack index to cracks smaller than 10 mm, a "C" crack index to cracks longer than 10 mm. Products presenting a crack index of A or B or products with crack length lower than 10 mm are considered as being crash resistant.

The absorbed energy was estimated by a "three-point bending test" according to VDA 238-100 (issued December 2010). The samples consisted in coupons with rectangular dimensions of 30 mm×60 mm. The dimension "60" being parallel to the extrusion direction. The punch radius r is equal to 0.4 mm.

At the beginning of the test the punch is put into contact with the coupon with a pre-load of 100 Newton. Once contact is established, the movement of the punch is indexed to zero. The test then is to move the punch so as to perform the "three-point bending" of the coupon. The test stops when damage led to a strong fall on the punch, at least 60 Newton, compared to the maximum force, or when the punch has reached maximum stroke allowed.

During the test, the force-displacement curve is recorded, which is used to calculate the absorbed energy by integrating the force to a certain displacement, here taken at 120 mm.

TABLE 2

Mechanical properties, crash performance of the investigated alloys (in T7 condition).

| | | | Properties | | | | |
|---|---|---|---|---|---|---|---|
| Alloy | Sample | | UTS (MPa) Extrusion direction | YS (MPa) Extrusion direction | Corrected Bending angle for 2 mm equivalent thickness (°) | Crash Index | Absorbed energy 120 mm N · mm |
| A | | Compar. | 245 | 224 | 124 | A | 12210 |
| B | B-1 | Compar. | 317 | 294 | 56 | C | 11589 |
| C | C-1 | Compar. | 325 | 304 | 58 | C | 12350 |
| D | D-1 | Invention | 316 | 287 | 98 | A | 15749 |
| E | E-1 | Invention | 339 | 314 | 84 | B | 13974 |
| F | F-1 | Invention | 336 | 310 | 80 | B | 14182 |
| G | G-1 | Invention | 337 | 310 | 92 | B | 14419 |

Samples D-1 to G-1 according to the invention present significant higher bending angles than samples A-1 to C-1, with a bending angle higher than 80°, while maintaining a good crash index of at least B and yield strength higher than 280 MPa. Samples E-1 to G-1 present an excellent compromise between strength, and crushability with a yield strength higher than 300 MPa.

It can be mentioned that samples B-1 and C-1 presents a yield strength close or higher than 300 MPa. However, they both exhibit a non-satisfactory crash behavior with a C crash index with cracks longer than 100 mm. This inappropriate compromise between strength and crash index is attributed to a too low level of Cu, compared to the invention.

The microstructure of the alloys (including precipitate morphology and length distribution) was analyzed using transmission electron microscopy (TEM). Samples were prepared by cutting 3 mm discs from a mid-thickness section of the extrusion, parallel to the extrusion direction. These discs were then electropolished in a solution of 30% nitric acid in methanol cooled to −40° C. using a Struers Tenupol. TEM analysis was carried out using a JEOL-2100 operating at 200 kV.

Figure 5:
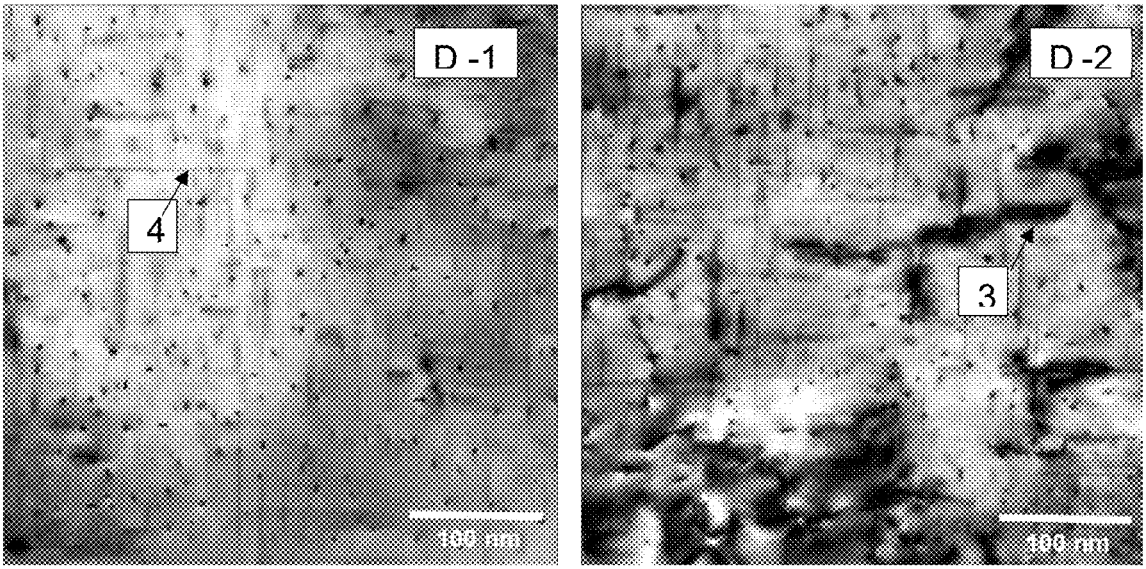
FIG. 5 corresponds to TEM micrographs taken according to <001> zone axis showing (Al,Si,Mg,Cu) precipitates.

Samples were orientated such that the matrix was aligned to the <001> zone axis, and imaged in bright-field mode. The precipitate length distribution was measured by imaging at 30,000-50,000× magnification (FIG. 5 D-1), and measuring the length of all elongated precipitates (4, FIG. 5 D-1) fully within the field of view, orientated perpendicular to the zone axis using ImageJ open source software. Statistics were based on a minimum of three fields of view, with each field of view typically containing fifty or more precipitates.

TABLE 3

Microstructural parameters of the investigated alloys

| | | | Mean precipitation Length (TEM) | | |
|---|---|---|---|---|---|
| Alloy | I.D. | | Average length (nm) | Standard deviation (nm) | Fraction of precipitates with a dimension longer than 100 nm (%) |
| A | A-1 | Compar. | 50 | 35 | 9 |
| B | B-1 | Compar. | 28 | 13 | 0 |
| D | D-1 | Invention | 56 | 43 | 15 |
| E | E-1 | Invention | 47 | 38 | 11 |
| F | F-1 | Invention | 39 | 34 | 8 |

The average length of the precipitates and their standard deviations as well as the fraction of precipitates longer than 100 nm for all investigated alloys are provided in Table 3. Size distribution of samples A-1, B-1 and E-1 are shown at FIG. 3. Histograms represent measured fraction distribution according to measured length of (Al,Si,Mg,Cu) precipitates. It is observed that with increasing Cu level, the length distribution tends to become wider, and longer precipitates (with lengths >100 nm) are present in these alloys. The alloys with best compromise between strength and crash performance are those with the highest fraction of precipitates with a dimension longer than 100 nm.

Example 2

Similarly to example 1, Alloy D of Table 1 was cast using DC-Cast Technology to produce logs having a diameter of 152 mm. The logs were homogenized at a temperature of 575° C. for at least 4 h and extruded on a direct extrusion press to form crash profiles as schematically shown in FIG. 2. Before extrusion, billets were submitted to a solutionising heat treatment by a fast heating to a temperature of 555° C. for 90 sec and subsequently cooled down to 500° C. prior to deformation. The extruded profiles exited from the extrusion press at an extrusion speed around 10 m/min and were then water quenched. Different interval of natural ageing were performed from 336 h to 0.5 h at room temperature (see Table 4). During this duration, tensile specimen were machined and keep at room temperature to measure the yield strength at the end of the natural ageing. After natural ageing, the crash profile was submitted to a pre-ageing treatment 150° C./3 h, followed by stretching at a rate of 5.5% and subsequently submitted to an artificial ageing at 190° C. for different duration (see Table 4).

Similar characterizations from example 1 was performed to characterize the mechanical strength properties and the microstructural properties of alloy D produced according to the thermomechanical processing (Table 4 and Table 5).

TABLE 4

| Mechanical properties | | | | | | | | | | |
|---|---|---|---|---|---|---|---|---|---|---|
| Alloy | ID. | Nat. age (h) | Pre-age | Def. (%) | $2^{nd}$ ageing | UTS (MPa) | YS (MPa) | Bending angle (°) | Crash Index | Absorbed energy 120 mm (N · mm) |
| D | D-1 | 40 | — | — | 150° C./3 h + 190° C./7 h | 316 | 287 | 98 | A | 15749 |
| D | D-2 | 336 | 150° C./3 h | 5.5 | 190° C./5 h | 316 | 298 | 95 | A | 14272 |
| D | D-3 | 6 | 150° C./3 h | 5.5 | 190° C./4 h | 322 | 307 | 90 | A | — |
| D | D-4 | 0.5 | 150° C./3 h | 5.5 | 190° C./3 h | 330 | 313 | 90 | A | — |

TABLE 5

| Microstructural parameters of the investigated Al alloys | | | | | |
|---|---|---|---|---|---|
| | | | Mean precipitation Length (TEM) | | |
| Alloy | ID. | | Average length (nm) | Standard deviation (nm) | Precipitates longer than 100 nm (%) |
| D | D-2 | Inv | 38 | 33 | 6.3 |

The yield strength of sample D-2 is significantly increased, compared to sample D-1 while maintaining crash performance by the application of thermomechanical processing. The strength is improved partly due to a higher dislocation density (3, shown in FIG. 5 D-2) and finer precipitates as it is illustrated with the average length measured at 38 nm for D-2 compared to D-1. There is also a higher proportion of precipitates with a length smaller than 20 nm coupled with a wide precipitate size distribution and significant proportion of precipitates longer than 100 nm (cf FIG. 4).

The invention claimed is:

1. An extruded product made of a 6xxx aluminum alloy comprising 0.40-0.70 wt. % Si,
0.40-0.80 wt. % Mg,
0.40-0.70 wt. % Cu,
up to 0.4 wt. % Fe,
up to 0.30 wt. % Mn,
up to 0.2 wt. % Cr,
up to 0.2 wt. % V,
up to 0.14 wt. % Zr,
up to 0.1 wt. % Ti,
up to 0.05 wt. % each impurity and 0.15% total, remainder aluminum, wherein the ratio $Mg/Si_{free}$ is between 0.8 and 1.2 where $Si_{free}$ is calculated according to the equation $Si_{free}=Si-0.3*(Mn+Fe)$ where Si, Mn and Fe correspond to the content in weight % of Si, Mn and Fe of said 6xxx aluminum alloy.

2. The extruded product made of a 6xxx aluminum alloy according to claim 1 wherein Cu content is from 0.45 to 0.70 wt. %.

3. The extruded product made of a 6xxx aluminum alloy according to claim 1 wherein the Mn content is lower than 0.1 wt. %.

4. The extruded product made of a 6xxx aluminum alloy according to claim 1 wherein the Cr content is lower than 0.1 wt. %.

5. The extruded product made of a 6xxx aluminum alloy according to claim 1 wherein the Zr content is lower than 0.10 wt. %.

6. The extruded product made of a 6xxx aluminum alloy according to claim 1 wherein the V content is lower than 0.1 wt. %.

7. The extruded product made of a 6xxx aluminum alloy according to claim 1, wherein said extruded product presents a recrystallized grain structure.

8. The extruded product made of a 6xxx aluminum alloy according to claim 1 wherein fraction of (Al, Si, Mg, Cu) precipitates with a dimension higher than 100 nm is higher than 5% when observed in TEM bright-field mode according to <001> zone axis direction.

9. The extruded product made of a 6xxx aluminum alloy according to claim 1 wherein tensile yield strength measured in the extrusion direction is equal or higher than 280 MPa, and with a bending angle higher than $113/\sqrt{e}$° measured on a coupon of 60 mm×60 mm×e according to VDA238-100 using a bending radius of 0.4 mm, where e is the thickness of the coupon in mm.

10. The extruded product according to claim 1, wherein the Si content is 0.50-0.70 wt. %.

11. The extruded product according to claim 1, wherein the Mg content is 0.40-0.60 wt. %.

12. The extruded product according to claim 1, wherein the Fe content is up to 0.3 wt. %.

13. A method for producing an extrusion product wherein said method comprises:

a) casting a billet from a 6xxx aluminum alloy,
b) homogenizing said cast billet
c) heating said homogenised cast billet;
d) extruding said heated billet through a die to form an extruded product;
e) quenching said extruded product down to room temperature;

f) natural Aging less than 100 days at room temperature said quenched product g) artificial aging said natural aged product to T6 or T7 temper;

wherein said 6xxx aluminium alloy comprises 0.40-0.70 wt. % Si, 0.40-0.80 wt. % Mg, 0.40-0.70 wt. % Cu, up to 0.4 wt. % Fe, up to 0.30 wt. % Mn, up to 0.2 wt. % Cr, up to 0.2 wt. % V, up to 0.14 wt. % Zr, up to 0.1 wt. % Ti, up to 0.05 wt. % each impurity and total 0.15 wt. %, remainder aluminum wherein the ratio $Mg/Si_{free}$ is between 0.8 and 1.2 where $Si_{free}$ is calculated according to the equation $Si_{free}=Si-0.3*(Mn+Fe)$ where Si, Mn and Fe correspond to the content in weight % of Si, Mn and Fe of said 6xxx aluminum alloy.

14. The method for producing an extrusion product according to claim 13 wherein natural aging treatment of f) is less than 24 h.

15. The method for producing an extrusion product according to claim 13, wherein i) the heating c) is a solution heat treatment wherein:

c1) said homogenised billet is heated to a temperature between Ts-60° C. and Ts, wherein Ts is the solidus temperature of said 6xxx aluminum alloy;

c2) said heated billet is quenched until its mean temperature reaches a value between 400° C. and 480° C. while ensuring that said billet surface temperature never goes below about 400° C.;

ii) said quenched billet is immediately extruded d) after the end of c2).

16. The method for producing an extrusion product according to claim 13, wherein said artificial aging treatment of g) comprises at least the following three successively j) an artificial preaging treatment with a duration t1 at a temperature T1 selected to increase the yield strength by 5% to 20% compared to the yield strength obtained after f), said temperature T1 being typically between 120° C. and 180° C. and said duration t1 being typically between 1 and 100 hours, to obtain an artificially preaged extrusion, jj) a plastic deformation of said artificially preaged extrusion between 1% and 80% to obtain a deformed extrusion, jjj) a final artificial aging treatment of said deformed extrusion with a duration t2 at a temperature T2, said temperature T2 being between 140° C. and 200° C. and said duration t2 being between 1 and 100 hours.

17. The method according to claim 13, wherein a cooling rate of e) quenching said extruded product down to room temperature is at least 50° C./s.

18. A product comprising an extruded product according to claim 7 for automotive application, as an automotive crash component, as a body in white application, or battery box in electrical vehicles.

* * * * *